United States Patent [19]

Marquis

[11] Patent Number: 4,634,815

[45] Date of Patent: Jan. 6, 1987

[54] IN-THE-EAR HEARING AID

[75] Inventor: Tierry Marquis, Flamatt, Switzerland

[73] Assignee: Gfeller AG, Bern, Switzerland

[21] Appl. No.: 702,968

[22] Filed: Feb. 19, 1985

[30] Foreign Application Priority Data

Feb. 21, 1984 [CH] Switzerland ..... 831/84

[51] Int. Cl.[4] ..... H04R 25/02

[52] U.S. Cl. ..... 387/68.4; 179/179; 381/68.6

[58] Field of Search ..... 179/107 E, 107 R, 178, 179/179, 182 R; 200/318, 340; 381/69

[56] References Cited

U.S. PATENT DOCUMENTS

| | | | |
|---|---|---|---|
| 2,267,364 | 12/1941 | Blount | 179/179 |
| 2,967,922 | 1/1941 | Dressel | 200/340 |
| 3,852,540 | 12/1974 | Diethelm | 179/107 E |
| 4,304,973 | 12/1981 | Fenelle et al. | 200/340 |
| 4,539,440 | 9/1985 | Sciarra | 179/107 E |

FOREIGN PATENT DOCUMENTS

| | | | |
|---|---|---|---|
| 3425211 | 8/1985 | Fed. Rep. of Germany | 179/107 R |

*Primary Examiner*—Gene Z. Rubinson

*Assistant Examiner*—Danita R. Byrd

*Attorney, Agent, or Firm*—Townsend and Townsend

[57] ABSTRACT

A face plate includes a passage for receiving a button cell. Disposed on the back of the face plate is a mounting plate. Between the mounting plate and the face plate, the edge of a diaphragm is gripped, the center part of which bulges resiliently outward. By means of pressure on the center part of the diaphragm, a circuit is closed. A cover having a center opening is hinged to the face plate. Through the opening there extends a pushbutton which is rotatable within limits relative to the cover and axially displaceable. Resting against the inside of the pushbutton is an annular contact element which is rotatingly integral therewith and has a contact tongue connected via a crosspiece. By rotating the pushbutton, the contact tongue can be brought into contact with a contact member disposed in a groove in the cover for turning on the hearing aid. By pressing the pushbutton, the button cell is axially displaced inwardly against the return force of the outwardly bulging portion of the diaphragm, and the mentioned circuit is closed. The hearing aid thus has only a single, relatively large operating element by means of which it can be turned on and off, and the volume controlled.

7 Claims, 5 Drawing Figures

IN-THE-EAR HEARING AID

BACKGROUND OF THE INVENTION

This invention relates to hearing aids, and more particularly to an in-the-ear hearing aid to be inserted in the auditory canal, of the type having a face plate, a rearwardly tapering housing adjoining the face plate, a button cell, and a cover hinged to the housing.

Miniaturized in-the-ear hearing aids of this type have already been proposed. By their nature, they have only a relatively small front surface for accommodating a closure member for the battery chamber and the operating elements for turning the appliance on and off and for controlling the volume. Since the face plate itself is so small, the operating elements must be still smaller, so that their manipulation becomes a real problem.

SUMMARY OF THE INVENTION

It is an object of this invention to provide an improved in-the-ear hearing aid in which the operating elements are as large as possible and their manipulation considerably simplified.

To this end, in the hearing aid according to the present invention, of the type initially described, the cover has a recess on the inside and an opening in its front wall through which a pushbutton extends, a mounting plate is disposed on the inside of the face plate, the front plate has a central passage, a pressure switch is disposed in the middle region of the passage on the side of the mounting plate adjacent to the face plate, and the button cell is held axially displaceably between the pressure switch and the pushbutton so that when the pushbutton is pressed, the button cell is displaced inwardly, and the button cell resting against the pressure switch actuates the pressure switch.

BRIEF DESCRIPTION OF THE DRAWINGS

A preferred embodiment of the invention will now be described in detail with reference to the accompanying drawing, in which.

DESCRIPTION OF THE PREFERRED EMBODIMENTS

Figure 1:
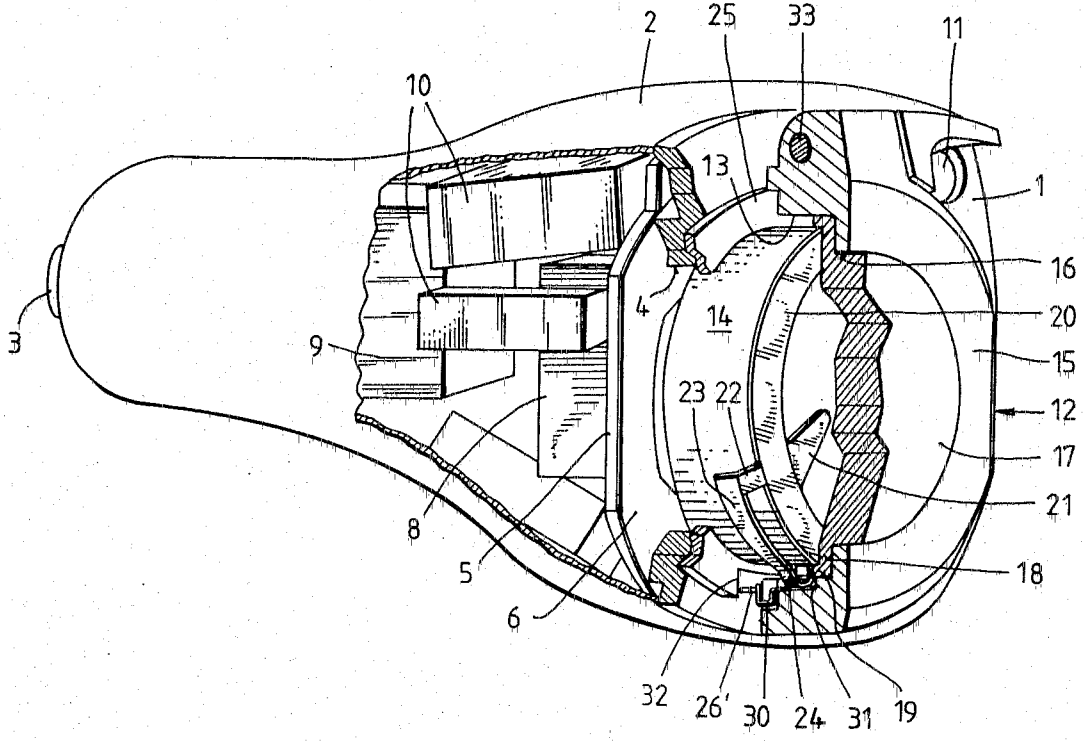
FIG. 1 is a perspective view, partially in section, of an embodiment of the in-the-ear hearing aid according to the present invention.

The embodiment of the present hearing aid shown in FIG. 1 is intended to be inserted directly into the outer canal of the ear. It is about 20 mm long and includes an approximately oval face area, the largest dimension of which is about 13 mm. Situated on the front is a face plate 1 immediately adjoining a housing 2. Housing 2 tapers toward the end remote from face plate 1, and it is at this rearward end that the outlet for the sound waves is situated. The exterior shape of housing 2 is preferably adapted to the shape of the wearer's auditory canal.

Face plate 1 includes a central passage 4, on the inside of which a mounting plate 5 is disposed. Between mounting plate 5, which is preferably a printed circuit board, and face plate 1, there is an electrically insulating, resilient diaphragm 6. The edge of diaphragm 6 is gripped between plate 5 and the edge of plate 1. The central part of diaphragm 6 is outwardly domed toward face plate 1 as will be described in more detail below with reference to FIG. 2. Disposed on the back of mounting plate 5 are a microphone 8 and a receiver 9, as well as electronic components 10. Microphone 8 communicates acoustically via a tube (not shown) with at least one sound entry aperture 11 in face plate 1.

Hinged to the outside of face plate 1 is a cover 12 having on the inside a recess 13 for partially receiving a button cell 14, and in its front wall 15 an opening 16 through which a pushbutton 17 extends.

Button 17 has a radially projecting rim 18 and an axially rearward projecting peripheral rib 19 adjacent thereto. Resting against rim 18 is an annular contact element 20 encircled by rib 19. Extending inward from contact element 20 are three contact tabs 21, only one of which is visible in FIG. 1. The free end of contact tab 21 is intended to rest against the bottom of button cell 14. Two contact tongues 23, only one of which is visible in FIG. 1, are connected to annular contact element 20 by a crosspiece 22. Contact tongues 23 extend substantially parallel to the sidewall of button cell 14 and to the cylindrical wall of recess 13. The free ends 24 of contact tongues 23 are bent first radially outward and then radially inward. The inside diameter of a retaining ring 25 set against the inside of cover 12 is somewhat larger than the outside diameter of cell 14 and prevents contact element 20 and button 17 from falling out when cover 12 is opened. Further details concerning cover 12 will be given below with reference to FIGS. 4 and 5.

Figure 2:
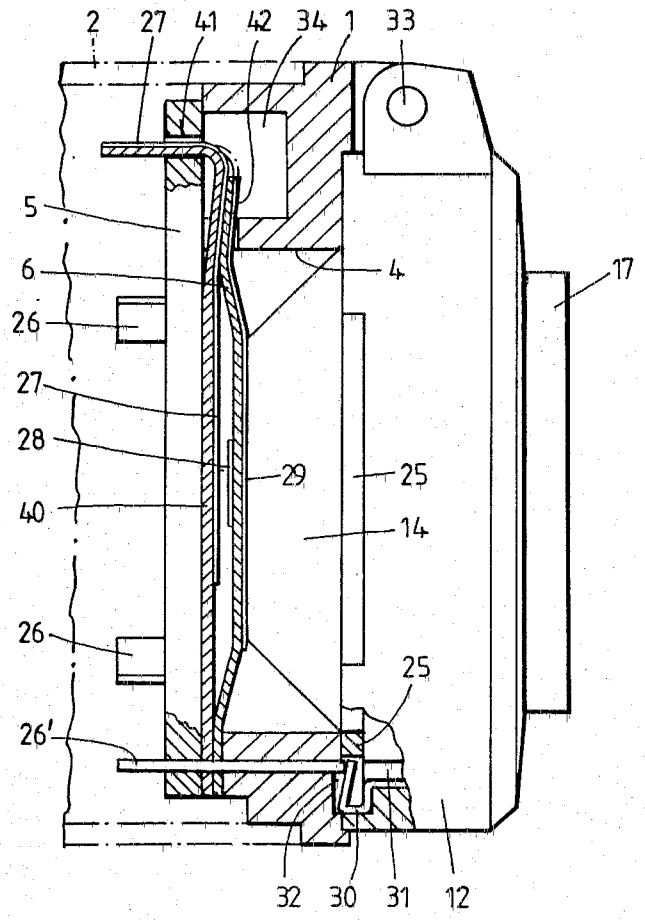
FIG. 2 is an elevation, partially in section, of the front part of the hearing aid of FIG. 1.

FIG. 2 shows cover 12 in side elevation, face plate 1 in section, mounting plate 5 in side elevation, the upper part of plate 5 in section, and diaphragm 6 in section. As state above, the center portion of diaphragm 6 is convex toward cover 12 when button 17 is not actuated and presses cell 14, contact element 20 (not shown in FIG. 2), and button 17 outward, rim 18 of button 17 then resting against the inside of recess 13 in cover 12. A number of soldering lugs 26, 26', e.g., five of them, are anchored in mounting plate 5; see also FIG. 3, which shows face plate 1 from the inside.

Diaphragm 6 is preferably made of a resilient plastic film, the margin of which is secured to another plastic film 40 resting against mounting plate 5. Evaporated onto film 40 are two conductor paths 27 which lead to the central area of film 40 and widen out there. The outer ends of conductor paths 27 extend, together with the strip portion of film 40 lying directly beneath them, through one of the rectangular openings 41 in plate 5.

Affixed to the inside of the central area of diaphragm 6 facing conductor paths 27 is a conductive zone 28 (e.g., a so-called contact tablet). When pushbutton 17 is pressed, contact element 20, button cell 14, and the central area of diaphragm 6 are axially displaced inwardly until conductive zone 28 rests against the two conductor paths 27 and interconnects them. As soon as there is no longer any outside force acting upon button 17, the aforementioned parts are pushed back again into their outer starting positions by diaphragm 6, thus breaking the connection between the two conductor paths 27. Zone 28 and the widened ends of paths 27 form a pressure switch which is closed when pushbutton 17 is pressed. Conductor paths 27 are the connections of the pressure switch.

Figure 3:
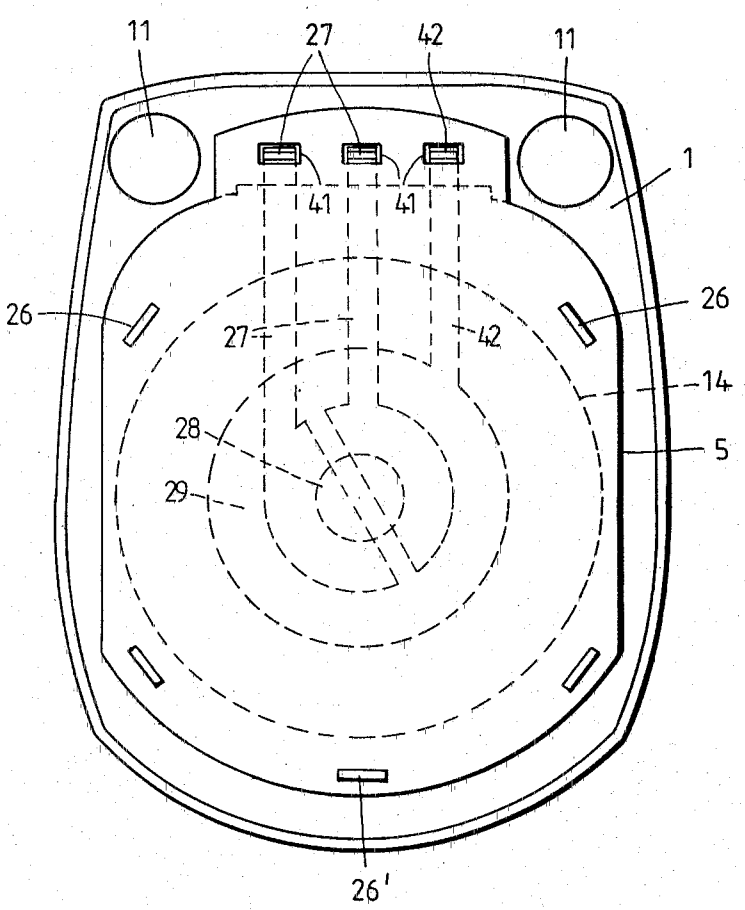
FIG. 3 is an elevation of the part depicted in FIG. 2 looking from the inside out.

The side of diaphragm 6 facing button cell 14 is coated with a conductive layer 29 connected to a conductor path 42 which extends through the opening 41 shown at the upper right in FIG. 3. This ensures the connection of conductor path 42 to one pole of cell 14. As explained above, the pressure switch comprising the two conductor paths 27 and conductive zone 28 can be actuated by means of the pushbutton, the connections of the pressure switch being the two conductor paths 27 shown in FIG. 3.

Soldering lug 26' extends through diaphragm 6 and axially through face plate 1 and is insulated from conductive layer 28. The end of lug 26' protruding slightly beyond the front of face plate 1 rests against a springy end of a contact member 30 disposed in an axially running groove 31 in the edge of cover 12 and in a recess 32 in retaining ring 25, as also shown in FIG. 1. It is further apparent from FIGS. 1 and 2 that the other pole of the button cell, i.e., its cup, is connected to soldering lug 26' via contact tab 21, annular contact element 20, crosspiece 22, and contact tongue 23, the twice-bent end of which rests against contact member 30, when pushbutton 17 is in the position shown in FIG. 1. When button 17 is actuated, the twice-bent end of contact tongue 23 slides on contact member 30, with the mentioned connection between parts 20 to 23 and 30 being broken thereby.

For casting reasons, face plate 1 has a recess 34 into which parts of conductor paths 27 and 42 project, and in which non-depicted electronic components can additionally be accommodated. Cover 12 can be hinged about an axis 33 and is kept closed by snap means (not shown).

Figure 5:
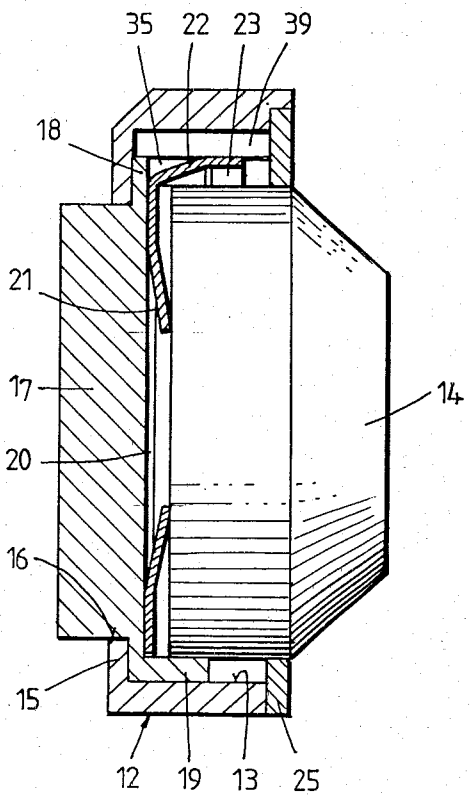
FIG. 5 is a section taken on the line V—V of FIG. 4.
Figure 4:
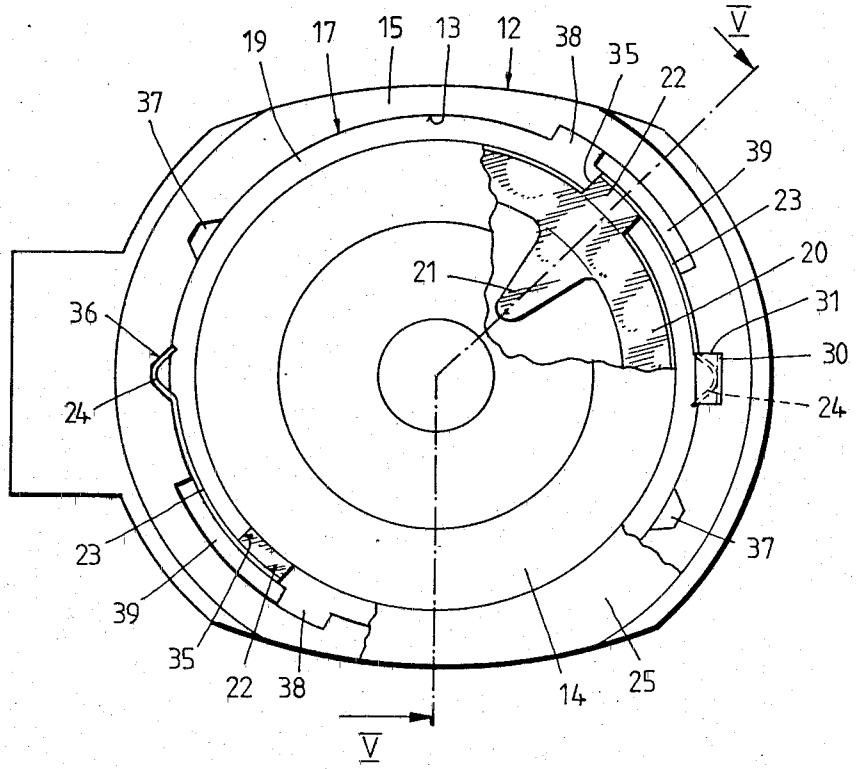
FIG. 4 is a top plan view of the inside of the hinged cover of the hearing aid of FIG. 1 with the button cell in place, the latter being shown partially cut away.

FIG. 4 shows cover 12 with inserted annular contact element 20, button cell 14, and retaining ring 25 placed thereon, as viewed from the inside, part of cell 14 and a large part of ring 25 being broken away. FIG. 5 is a section through cover 12 taken on the line V—V of FIG. 4. Because retaining ring 25 is for the most part broken away in FIG. 4, the two contact tongues 23 disposed opposite one another in the annular space between the cylindrical inside of recess 13 in cover 12 and the sidewall of button cell 14 are visible. Crosspiece 22, connecting contact tongues 23 to annular contact element 20, extend at an angle through respective recesses 35 in peripheral rib 19 of pushbutton 17. Contact element 20 and the two contact tongues 23 are thus integral for rotation with pushbutton 17.

As described above, the twice-bent end 24 of the one contact tongue 23 rests upon contact part 30 disposed in groove 31 of cover 12. At the location opposite groove 31 on cover 12 there is another groove 36 into which the twice-bent end of the other contact tongue 23 projects. About 30° away from grooves 31 and 36 there are further grooves 37 into which the twice-bent ends of contact tongues 23 snap when pushbutton 17 is rotated clockwise, as viewed in FIG. 4. The rotation of button 17 is limited by two shoulders 38 running axially on the outside of rib 19 of button 17, each of these shoulders projecting into a respective arcuate notch 39 on the inside of cover 12. When button 17 is rotated into the position not shown in FIG. 4, the connection between soldering lug 26' and the other pole of button cell 14 is broken, and the hearing aid illustrated in FIG. 1 is thereby turned off.

In groove 36, just as in groove 31, a contact member (not shown) cooperating with a further soldering lug (not shown) passing through face plate 1 may be disposed, thus increasing contact reliability. By means of the pressure switch formed of the two conductor paths 27 and conductive zone 28, a memory flip-flop may be controlled, capable of setting two different volumes through pressure on the pushbutton, for example. Provision may also be made for a counter which controls the volume depending upon the count. The count increases when button 17 is pressed briefly; when it is pressed longer, the count decreases and the volume becomes lower.

What is claimed is:

1. An in-the-ear hearing aid to be inserted in the auditory canal, of the type having a face plate, a housing adjoining and tapering away from said face plate, a button cell having a sidewall, and a cover hinged to said housing, wherein the improvemnt comprises:

said face plate including a central passage, said cover including a recess having a cylindrical inside wall in the side of said cover nearest said housing and an opening in the side of said cover remote from said housing, a pushbutton passing through said opening, a mounting plate disposed on the side of said face plate nearest said housing, a pressure switch disposed substantially in the middle of said central passage of said face plate on the side of said mounting plate nearest said face plate, and means for holding said button cell axially displaceable between said pressure switch and said pushbutton in such a way that pressure exerted upon said pushbutton causes said button cell to move toward and rest against said pressure switch, thereby actuating said pressure switch.

2. The hearing aid of claim 1, wherein said pressure switch comprises two conductor paths disposed on said mounting plate, a resilient, electrically insulating diaphragm having a peripheral portion gripped between said mounting plate and said face plate and a central portion convex toward said cover, and an electrically conductive zone situated on the side of said central portion nearest said mounting plate, said conductive zone interconnecting said conductor paths upon pressing of said pushbutton.

3. The hearing aid of claim 2, further comprising an electrically conductive layer disposed on the side of said diaphragm remote from said mounting plate for establishing an electrical connection to a pole of said button cell.

4. The hearing aid of claim 2, wherein said cover includes at least one axial groove, further comprising a substantially annular contact element resting against the side of said pushbutton nearest said button cell and being at least partially in contact with a pole of said button cell, at least one contact tongue extending substantially parallel to said sidewall of said button cell, a radially positioned crosspiece securing said contact tongue to said contact element, a contact member disposed in a said axial groove of said cover and cooperating with said contact tongue, and a soldering lug extending through said mounting plate, through said peripheral portion of said diaphragm, and through said face plate, whereby said contact member and said soldering lug are interconnected when said cover is closed.

5. The hearing aid of claim 4, wherein said pushbutton includes a radially projecting rim and an axially rearwardly projecting peripheral rib adjacent thereto, said rib including on the outside circumference thereof two oppositely disposed, radially protruding shoulders, said cover further including in said cylindrical inside wall of said recess two arcuate notches for respectively receiving said shoulders and thereby limiting rotation of said pushbutton relative to said cover, said peripheral rib of said pushbutton further including a recess for receiving said crosspiece, whereby said contact element and said pushbutton are made integral for rotation.

6. The hearing aid of claim 5, wherein said annular contact element includes at least one radially inward extending contact tab biased away from said pushbutton.

7. The hearing aid of claim 6, further comprising a retaining ring positioned at the periphery of the inside of said cover, the inside diameter of said retaining ring being greater than the outside diameter of said button cell, whereby said button cell is axially displaceable relative to said cover.

* * * * *